US006475427B1

(12) United States Patent
Deshmukh et al.

(10) Patent No.: US 6,475,427 B1
(45) **Date of Patent: *Nov. 5, 2002**

(54) GOLF CLUB WITH MULTIPLE MATERIAL WEIGHTING MEMBER

(75) Inventors: Uday V. Deshmukh, Oceanside, CA (US); Kenneth S. Vecchio, San Diego, CA (US); Joel B. Erickson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 62 days.

This patent is subject to a terminal disclaimer.

(21) Appl. No.: 09/584,920

(22) Filed: May 31, 2000

(51) Int. Cl.[7] ..... B22F 3/12; B22F 7/00

(52) U.S. Cl. ..... 419/8; 419/38; 419/47; 419/57

(58) Field of Search ..... 419/8, 38, 47, 419/57

(56) References Cited

U.S. PATENT DOCUMENTS

| | | | | |
|---|---|---|---|---|
| 4,071,354 A | | 1/1978 | Mocarski | |
| 4,092,223 A | | 5/1978 | Kaufman | |
| 4,382,818 A | | 5/1983 | Mocarski | |
| 4,591,481 A | | 5/1986 | Lueth | |
| 4,931,241 A | | 6/1990 | Freitag | |
| 4,992,236 A | * | 2/1991 | Shira | 419/28 |
| 5,000,779 A | | 3/1991 | German et al. | |
| 5,094,810 A | * | 3/1992 | Shira | 419/6 |
| 5,098,469 A | | 3/1992 | Rezhets | |
| 5,154,425 A | * | 10/1992 | Niskanen et al. | 273/167 J |
| 5,340,107 A | * | 8/1994 | Baker et al. | 273/167 R |
| 5,342,812 A | * | 8/1994 | Niskanen et al. | 501/127 |
| 5,441,553 A | | 8/1995 | Polizzotti et al. | |
| 5,776,010 A | | 7/1998 | Helmstetter et al. | |
| 5,863,492 A | | 1/1999 | Bose | |
| 6,027,010 A | | 2/2000 | Shira | |
| 6,030,294 A | | 2/2000 | Shira | |
| 6,227,985 B1 | * | 5/2001 | Mizushima et al. | 473/319 |
| 6,319,437 B1 | * | 11/2001 | Elsner et al. | 264/44 |

* cited by examiner

*Primary Examiner*—Daniel J. Jenkins
(74) *Attorney, Agent, or Firm*—Michael A. Catania

(57) ABSTRACT

The use of liquid phase sintering for weighting of a golf club head is disclosed herein. The preferred weighting material is a multiple component material that includes a high-density component, a binding component and an anti-oxidizing component. A preferred multiple component material includes tungsten, copper and chromium. The liquid phase sintering process is performed in an open air environment at standard atmospheric conditions.

9 Claims, 8 Drawing Sheets

GOLF CLUB WITH MULTIPLE MATERIAL WEIGHTING MEMBER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club. More specifically, the present invention relates to a golf club with a weighting member composed of multiple materials.

2. Description of the Related Art

Golf club designs are constantly evolving with the primary purpose to improve a golfer's performance. While the improvements may address a number of areas, a designer strives to design a more forgiving golf club. Forgiveness in a golf club may be achieved by shifting the center-of-gravity of a golf club to a desirable location, and creating a larger moment of inertia.

It is difficult to increase forgiveness in a golf club head composed of a homogeneous or monolithic material, such as stainless steel, since there is a limit on the overall weight of a golf club acceptable to the typical golfer. To overcome this difficulty, designers have resorted to combining different materials (high density and low density) to achieve the desired center-of-gravity and large moment of inertia. A very high-density material provides a designer with the greatest freedom in improving the performance of a golf club head since less volume is needed to achieve the proper weighting. The most economical, commercially available material with a very high density is tungsten, which has a density of 19.3 grams per cubic centimeter.

One challenge in using heterogeneous materials is the ability to join the materials together in a golf club head. Numerous techniques have been created by the golf industry to join heterogeneous materials in a golf club head. One example is the GREAT BIG BERTHA® TUNGSTEN-TITANIUM™ irons, developed by the Callaway Golf Company of Carlsbad, Calif., which used a screw to attach a tungsten block to the rear and sole of a titanium iron. Another example is the GREAT BIG BERTHA® TUNGSTEN-INJECTED™ HAWK EYE® irons, also developed by the Callaway Golf Company, which feature an internal cavity with tungsten pellets in a solder, as set forth in U.S. Pat. No. 6,210,290, for an Internal Cavity Tungsten Titaniun Iron, filed on Jun. 11, 1999. An example of a wood is the GREAT BIG BERTHA® HAWK EYE® drivers and fairway woods, also developed by the Callaway Golf Company, which use a tungsten screw in the sole of a titanium club head body. Other techniques use adhesives to join the materials, press fit the materials, braze the materials, or structurally hold one material piece within another material piece using undercuts or pockets.

For the most part, these techniques require a precisely machined weighting piece to fit within a precise location on a golf club head. The most economical method is to cast a golf club head body with a cavity for the weighting piece and attaching the weighting piece with a screw. However, casting tolerance are low, and require either machining of the cavity itself, or machining of the weighting piece to fit each cavity. The use of softer materials is undesirable since this creates difficulty in finishing the final product due to smearing of such soft materials during grinding of the golf club head.

Further, a co-casting process, where the weighting piece is incorporated in the mold prior to pouring the base metal, is very problematic depending on the materials since the weighting piece is relatively cold when the hot liquid base metal is cast around it causing thermal shock. Also, thermal expansion mismatch of materials is a problem with co-casting of heterogeneous materials. Other problems arise during re-shafting, where the golf club head is heated to remove the shaft. Such heating will result in low melting temperature materials (epoxies and solder) to flow, resulting in the possible movement of weighting pieces.

BRIEF SUMMARY OF THE INVENTION

The present invention allows for a golf club head to be easily weighted without precisely machined weighting components. The present invention is able to accomplish this by using liquid phase sintering for incorporating a weighting member composed of a multi-component material into the golf club head.

The most general aspect of the present invention is a golf club head with a body and a weighting member. The body has a striking plate, a heel end, a toe end and a cavity. The weighting member is composed of a multi-component material and is disposed in the cavity of the body.

Another aspect of the present invention is a cavity back golf club head having a body and a weighting member. The body has a striking plate, a toe end, a heel end and a main rear cavity opposite the striking plate. A top wall, a bottom wall, a heel wall and a toe wall define the main rear cavity. The bottom wall has a second cavity with a predetermined configuration. The weighting member is disposed within the second cavity and occupies the entire cavity. The weighting member is composed of a multi-component material.

Yet another aspect is a method for manufacturing a golf club head. The method includes introducing a multi-component powder/pellet mixture into a cavity on a body of a golf club head, and heating the multi-component powder/pellet mixture to a predetermined temperature for liquid phase sintering of the multi-component powder/pellet mixture. The predetermined temperature is above the melting temperature of one component of the multi-component powder/pellet mixture.

The multi-component powder/pellet mixture may be composed of a heavy metal component, an anti-oxidizing component and a metal binder component. One variation of the multi-component powder/pellet mixture may be composed of tungsten, copper and an anti-oxidizing component. The anti-oxidizing component may be chromium or any chromium containing alloy such as nickel-chrome, stainless steel or nickel-chromium superalloy. Preferably, the anti-oxidizing component is nickel chrome.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
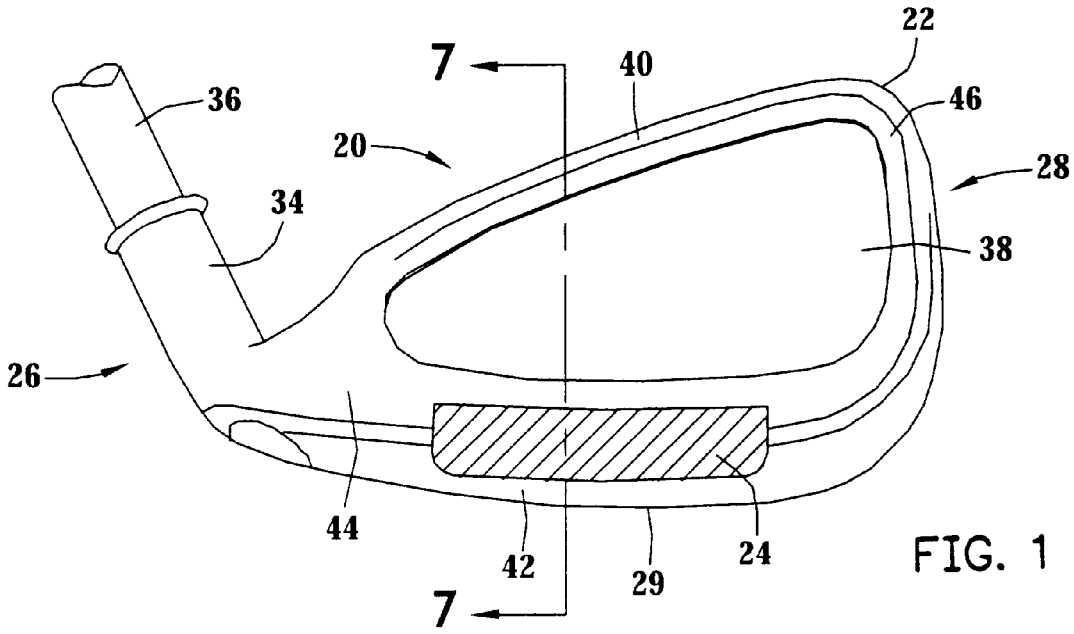
FIG. 1 is a rear plan view of a golf club head of the present invention.
Figure 2:
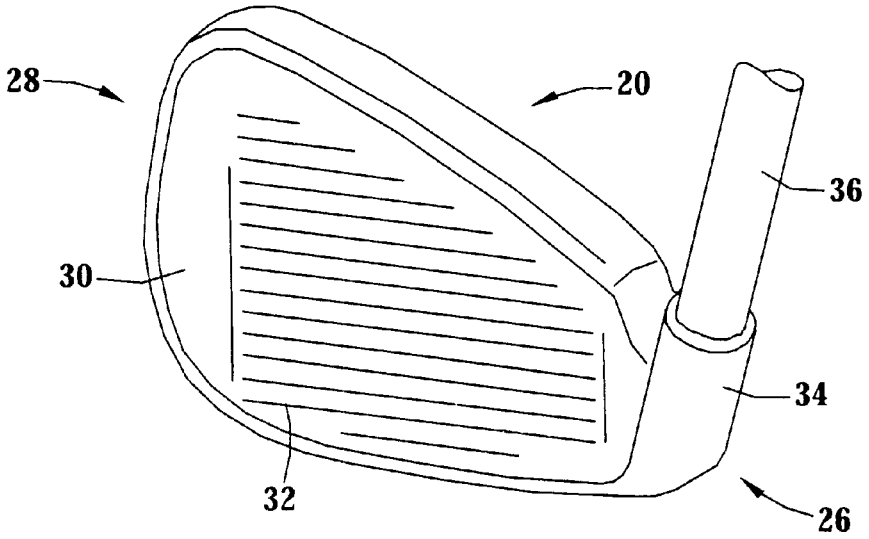
FIG. 2 is a front plan view of the golf club head of FIG. 1.
Figure 3:
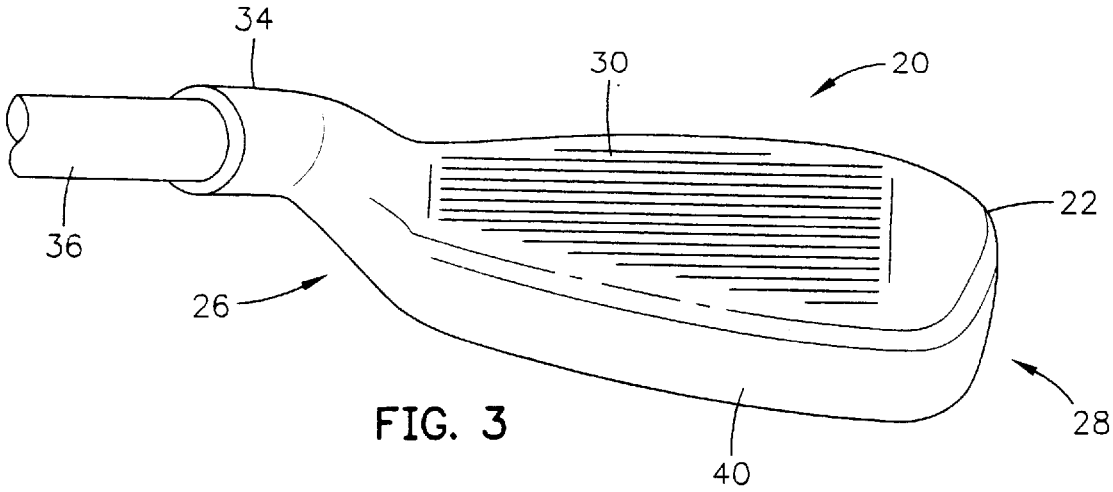
FIG. 3 is a top perspective view of the golf club head of FIG. 1.
Figure 4:
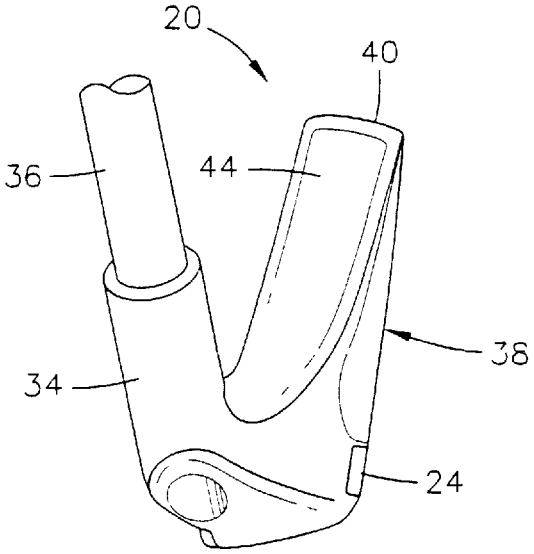
FIG. 4 is a heel end perspective view of the golf club head of FIG. 1.
Figure 5:
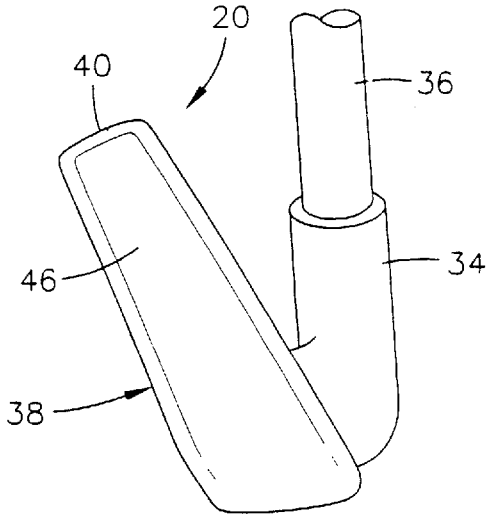
FIG. 5 is a toe end perspective view of the golf club head of FIG. 1.
Figure 6:
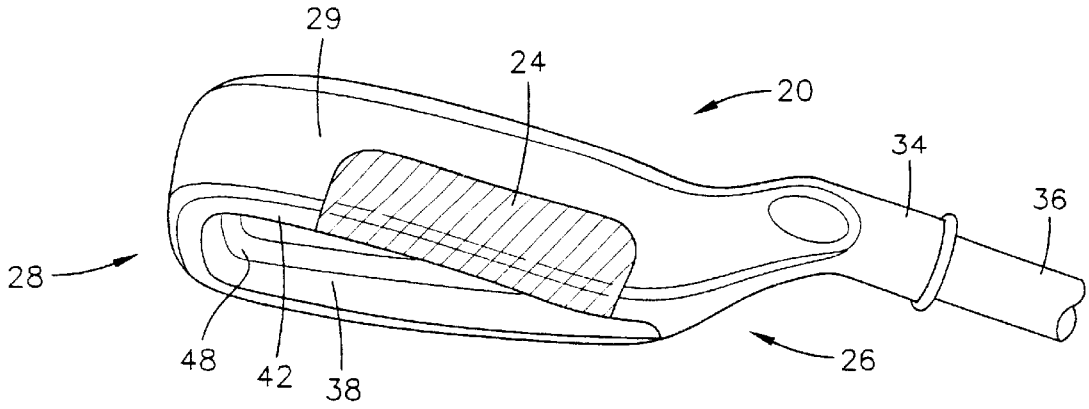
FIG. 6 is a bottom perspective view of the golf club head of FIG. 1.

As shown in FIGS. 1–7, a golf club head is generally designated 20. The golf club head 20 is a cavity-back iron with a body 22 and a weighting member 24. The golf club head 20 has a heel end 26, a toe end 28 and a sole 29. On the front of the body 22 is a striking plate 30 that has a plurality of scorelines 32 therein. A hosel 34 for receiving a shaft 36 is located on the heel end 26 of the golf club head 20. The rear of the golf club head 20 has a main cavity 38 that is defined by a top wall 40, a bottom wall 42, a heel wall 44 and a toe wall 46. The golf club head 20 also has an optional undercut recess 48 circumventing and openly exposed to the main cavity 38.

Figure 7:
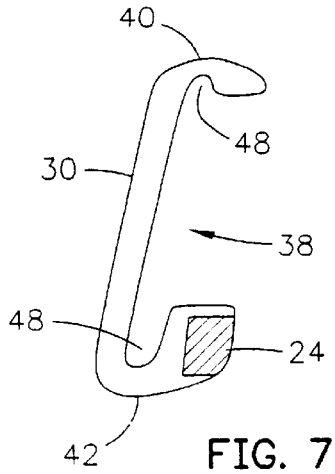
FIG. 7A is a cross-sectional view of an alternative embodiment of the cavity for the weight member of the golf club head of FIG. 1 along line 7—7.
FIG. 7B is a cross-sectional view of an alternative embodiment of the cavity for the weight member of the golf club head of FIG. 1 along line 7—7.

The weighting member 24 is composed of multiple component powder or pellet mixture that is processed via liquid phase sintering within a cavity 25 (shown in FIG. 11) of the body 22. The cavity 25 is preferably open to the sole 29 and the bottom wall 42. However those skilled in the pertinent art will recognize that the cavity 25, and hence the weighting member 24, may be disposed in numerous locations to provide a desired affect. As shown in FIG. 7, the weighting member 25 locates a large percentage of the mass of the golf club head 20 in the lower center of the golf club head 20 thereby lowering the center of gravity of the golf club head 20 to make it more forgiving for a golfer.

Figure 7A:
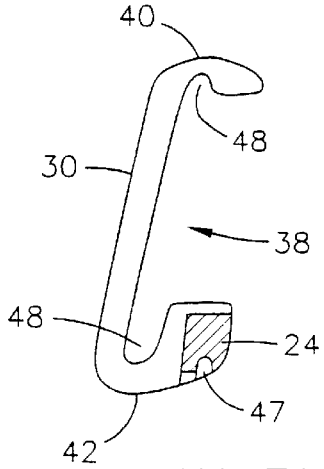
Figure 7B:
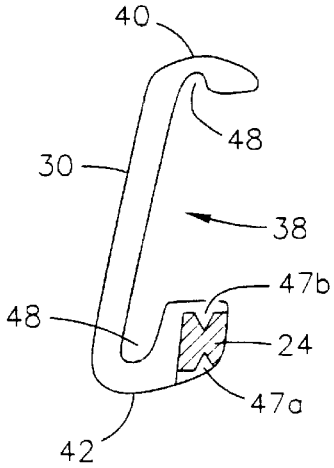
Figure 8:
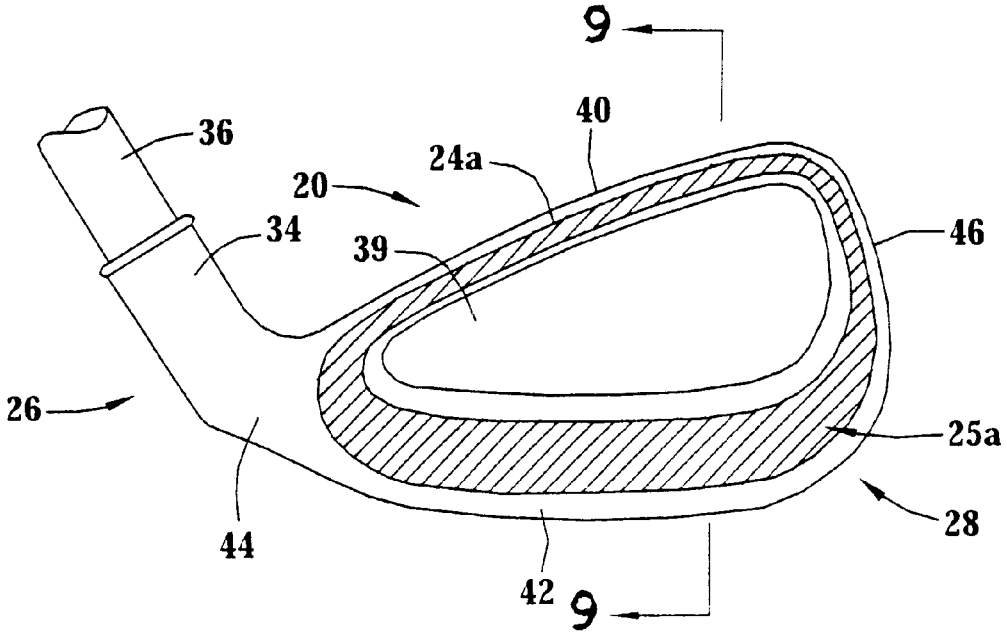
FIG. 8 is a rear plan view of an alternative embodiment of the golf club head of the present invention.
Figure 9:
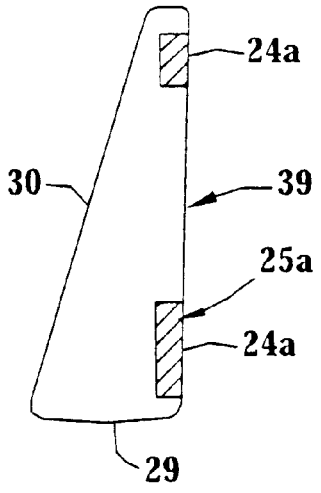
FIG. 9 is a cross-sectional view of the golf club head of FIG. 8 along line 9—9.

An alternative embodiment of the golf club head 20*a* of the present invention is illustrated in FIGS. 8 and 9. The golf club head 20*a* is a blade-style iron as compared to the cavity-back iron of FIGS. 1–7. The golf club head 20*a* of FIGS. 8 and 9 does not have a cavity 38, nor does it have an undercut 48. The weighting member 24*a* is disposed annularly about the rear 39 of the body 22. Further, the cavity 25*a* containing the weighting member 24*a* is open only to the rear 39 and not the sole as in the previous embodiment. The annular weighting member 24*a* allows for the blade style golf club head 20*a* to have perimeter weighting similar to a cavity-back iron, and thus the forgiveness of a cavity-back iron while having the traditional appearance of a blade iron. The annular weighting member 24*a* will occupy a greater volume of the golf club head 20*a* than the weighting member 24 of FIGS. 1–7, and thus will also have a greater percentage of the mass of the golf club head 20*a*. The weighting member of the present invention may occupy various contoured cavities of golf club heads due to its unique manufacturing method. As shown in FIGS. 7A and 7B, the cavity 25*b* may have an interior projection 47, or the cavity 25*c* may have a plurality of interior projections 47*a* and 47*b*. The interior projections 47 create a structural means for retaining the weighting member 24 within the cavity 25*b* or 25*c*.

Figure 10:
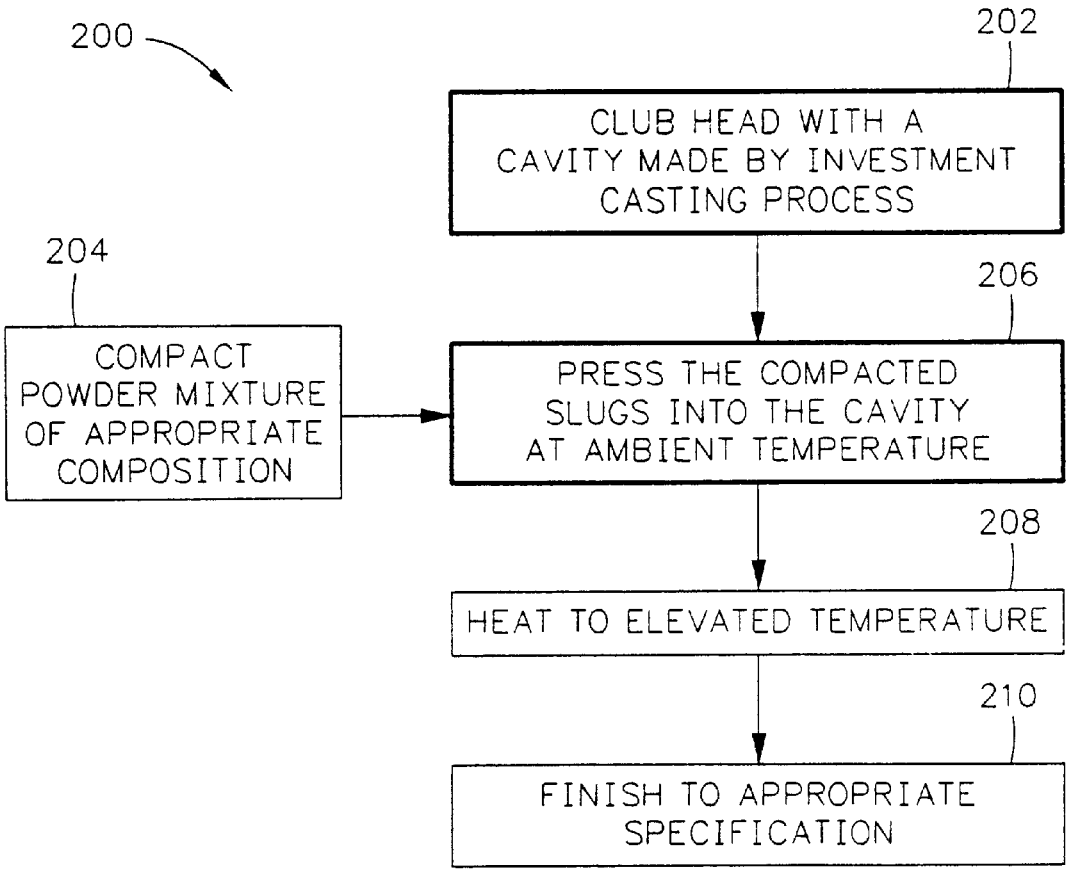
FIG. 10 is a flow chart of the process of the present invention.
Figure 11:
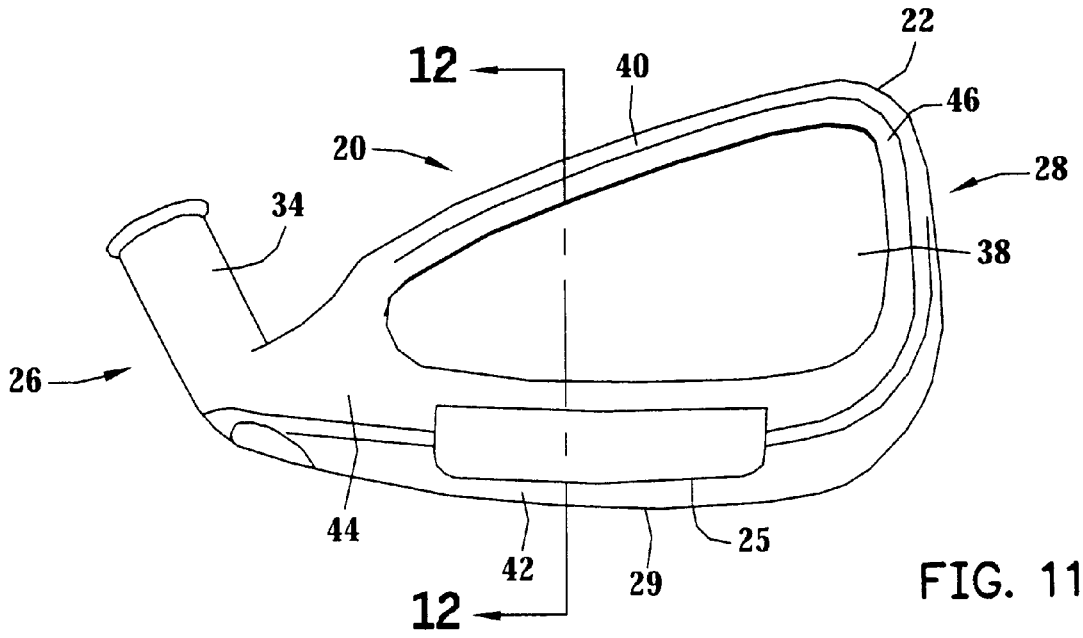
FIG. 11 is a rear plan view of an unfinished golf club head of the present invention.
Figure 12:
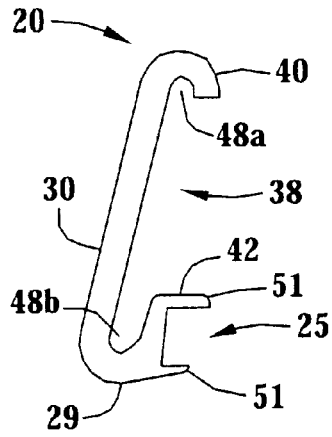
FIG. 12 a cross-sectional view of the unfinished golf club head of FIG. 11 along line 12—12.

FIG. 10 illustrates a flow chart of the process of the present invention for producing a golf club head 20 or 20*a* with a weighting member 24 or 24*a* composed of a multiple component powder or pellet mixture. The process 200 begins with providing a golf club head 20, preferably prepared by a conventional investment casting process at block 202. However, those skilled in the pertinent art will recognize that the golf club head 20 or 20*a* may be prepared through other techniques well know in the golf industry, such as forging. The golf club head 20 may be composed of stainless steel, titanium, titanium alloys, zirconium, zirconium alloys, or like materials. The golf club head 20 is cast to have a cavity 25, as shown in FIG. 11. The cavity 25 has a predetermined volume according to the amount of mass needed from the weighting member 24 for the golf club head 20. At block 204, the precursor powder materials for the multiple component powder or pellet mixture are compacted for placement into the cavity 25. The mixture may be composed of powders, pellets or a mixture thereof. The precursor powder or pellet materials are composed of a high-density component in various particle sizes (ranging from 1.0 mm to 0.01 mm) for achieving low porosity for the weighting member 24. The preferred high-density component is tungsten which has a density of 19.3 grams per cubic centimeter ("g/cm$^3$"), however other high-density materials may be used such as molybdenum (10.2 g/cm$^3$), tantalum (16.7 g/cm$^3$), platinum (21.4 g/cm$^3$), rhodium (12.4 g/cm$^3$), and the Additionally, high-density ceramic powders may be utilized as the high-density component. The amount of high-density component in the mixture may range from 5 to 95 weight percent of the weighting member 24.

In addition to a high-density component such as tungsten, the multiple component powder or pellet mixture is composed of a binding component such as copper (density of 8.93 g/cm$^3$), copper alloys, tin (density of 7.31 g/cm$^3$), and the like. The multiple component powder or pellet mixture is also composed of an anti-oxidizing powder such as chromium (density of 7.19 g/cm$^3$), nickel-chromium alloys (density of 8.2 g/cm$^3$), or iron-chromium alloys (density of 7.87 g/cm$^3$). Alternative anti-oxidizing components include aluminum, titanium, zirconium and the like. The binding component in the multiple component powder or pellet mixture may range from 4 to 49 weight percent of the weighting member 24. The anti-oxidizing component in the alloy may range from 0.5 to 30 weight percent of the weighting member 24. The weighting member 24 is preferably 90 weight percent tungsten, 8 weight percent copper and 2 weight percent chromium. The overall density of the weighting member 24 will range from 11.0 g/cm$^3$ to 17.5 g/cm$^3$, preferably between 12.5 g/cm$^3$ and 15.9 g/cm$^3$, and most preferably 15.4 g/cm$^3$. Table one contains the various compositions and their densities.

Figure 13:
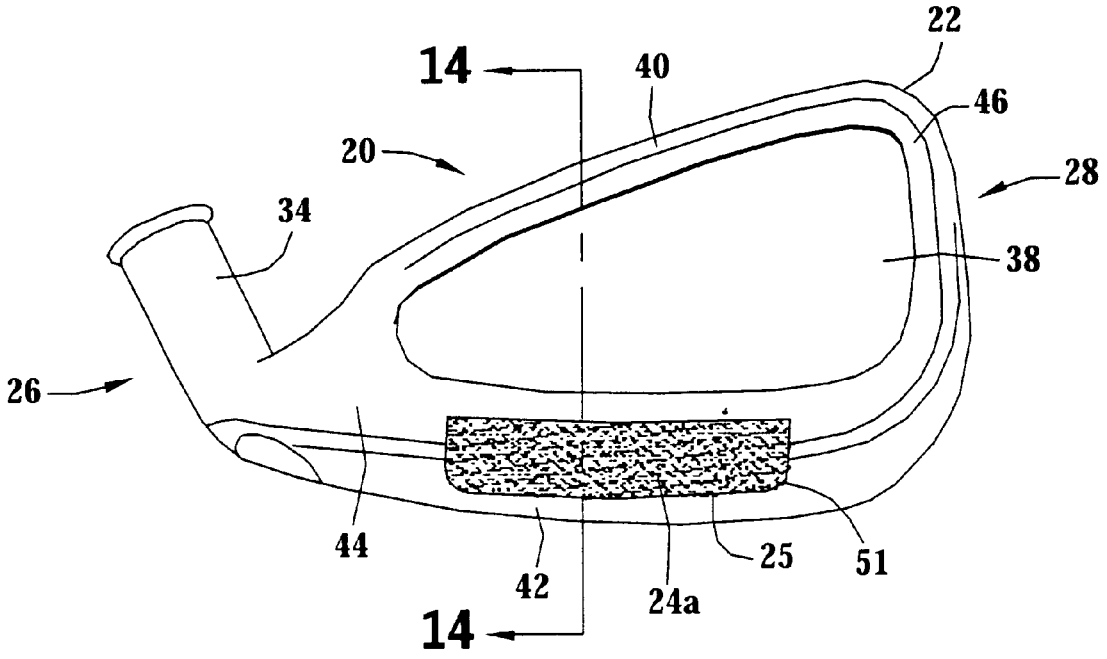
FIG. 13 is a rear plan view of the unfinished golf club head of FIG. 11 with the powder precursor material therein.

Returning to FIG. 10, the powders are thoroughly mixed to disperse the anti-oxidizing component throughout the multiple component powder or pellet mixture to prevent oxidizing which would lead to porosity in the weighting member 24. The anti-oxidizing component gathers the oxides from the multiple component powder or pellet mixture to allow for the binding component to "wet" and fill in the cavities of the multiple component powder or pellet mixture. Also, if the surface of the weighting member 24 engaging the wall of the cavity 25 is oxidized, adherence of the weighting member 24 could be decreased resulting in failure. The multiple component powder or pellet mixture is preferably compacted into slugs for positioning and pressing within the cavity 25 at block 206, and as shown in FIG. 13. Higher densities are achieved by compacting the multiple component powder or pellet mixture prior to placement within the cavity 25. The mixture is pressed within the cavity 25 at a pressure between 10,000 pounds per square inch ("psi") to 100,000 psi, preferably 20,000 psi to 60,000 psi, and most preferably 50,000 psi.

Figure 14:
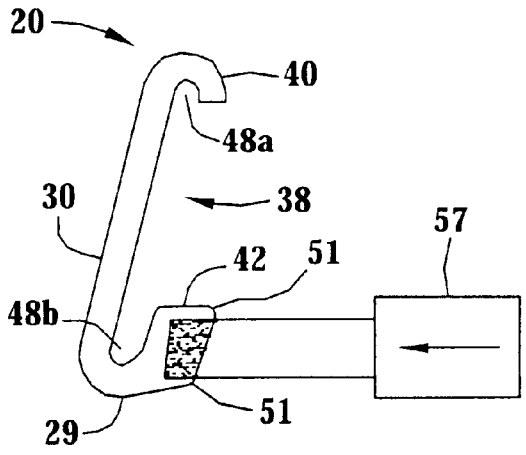
FIG. 14 is a rear plan view of the unfinished golf club head of FIG. 11 with the precursor material following liquid phase sintering.

Once the multiple component powder or pellet mixture, in compacted form or uncompacted form, is placed within the cavity 25, at block 208 the unfinished golf club head 20*b* is placed within a furnace for liquid phase sintering of the multiple component powder or pellet mixture under standard atmospheric conditions and in air. More precisely, the process of the present invention does not require a vacuum nor does it require an inert or reducing environment as used in the liquid phase sintering processes of the prior art. In the furnace, the multiple component powder or pellet mixture is heated for 1 to 30 minutes, preferably 2 to 10 minutes, and most preferably 5 minutes. The furnace temperature for melting at least one component of the mixture is in the range of 900° C. to 1400° C., and is preferably at a temperature of approximately 1200° C. The one component is preferably the binding component, and it is heated to its melting temperature to liquefy as shown in FIG. 14. However, those skilled in the art will recognize that the liquid phase sintering temperature may vary depending on the composition of the multiple component powder or pellet mixture. Preferably the binding component is copper, and the liquid phase sintering occurs at 1200° C. to allow the copper to fill in the cavities of the multiple component powder or pellet mixture to reduce porosity and thus increase the density of the weighting member 24. As the copper liquefies, the tungsten (melting temperature of 3400° C.), or other high-density component, remains in a powder form while the chromium or other anti-oxidizing component removes the oxides from the mixture to allow the copper to occupy the cavities and to reduce porosity caused by the oxides.

At block 210, the unfinished golf club head with the weighting member 24 therein is finished through milling, grinding, polishing or the like. Those skilled in the art will recognize that the density of the weighting member 24 will change depending on the particular club within a set of irons, or fairway wood or putter. The density is manipulated through modifying the amount of high density component, such as tungsten, in the mixture as shown in Table One.

Table One illustrates the compositions of the multiple component powder or pellet mixture, the processing temperatures, the theoretical or expected density, and the measured density. The processing was conducted at standard atmospheric conditions (1 atmosphere) and in air as opposed to the reducing environment of the prior art. The theoretical or expected density is the density if mixture was processed in a reducing environment under high pressure. The present invention is able to achieve between 70% to 85% of the theoretical density by using a method that does not require a reducing environment and high pressures.

TABLE ONE

| Composition | Temp. | Expected Density | Measured Density |
|---|---|---|---|
| 1. 85.0 W + 7.5 Copper + 7.5 Ni-Cr | 1200 | 17.72 | 12.595 |
| 2. 85.0 W + 7.5 Copper + 7.5 Ni-Cr | 1200 | 17.72 | 12.595 |
| 3. 85.0 W + 7.5 Copper + 7.5 Ni-Cr | 1200 | 17.72 | 12.375 |
| 4. 85.0 W + 7.5 Copper + 7.5 Ni-Cr | 1200 | 17.72 | 12.815 |
| 5. 85.0 W + 7.5 Copper + 7.5 Ni-Cr | 1200 | 17.72 | 13.002 |
| 6. 85.0 W + 7.5 Copper + 7.5 Ni-Cr | 1200 | 17.72 | 12.386 |
| 7. 85.0 W + 7.5 Copper + 7.5 Ni-Cr | 1200 | 17.72 | 13.123 |
| 8. 85.0 W + 7.5 Copper + 7.5 Ni-Cr | 1200 | 17.72 | 14.069 |
| 9. 80.0 W + 10 Copper + 10 Ni-Cr | 1200 | 17.19 | 11.935 |
| 10. 80.0 W + 7 Copper + 7 Ni-Cr + 6 Sn | 1200 | 17.1 | 12.815 |
| 11. 80.0 W + 10 Bronze + 8 Ni-Cr + 2 Sn | 1200 | 17.16 | 12.452 |
| 12. 85.0 W + 15 Sn | 300 | 17.49 | 14.454 |
| 13. 84.0 W + 14 Sn + 2 Ni-Cr | 300 | 17.4 | 14.295 |
| 14. 82.0 W + 12 Sn + 6 Ni-Cr | 300 | 17.21 | 13.695 |
| 15. 80.0 W + 18 Cu + 2 Fe-Cr | 1200 | 17.19 | 12.75 |
| 16. 80.0 W + 16 Cu + 4 Fe-Cr | 1200 | 17.16 | 12.254 |
| 17. 80.0 W + 16 Cu + 4 Fe | 1200 | 17.18 | 12.518 |
| 18. 80.0 W + 17 Cu + 3 Cr | 1200 | 17 | 12.98 |
| 19. 90.0 W + 8.75 Cu + 1.25 Ni-Cr | 1200 | 18.26 | 14.157 |
| 20. 60.0 W + 35 Cu + 5 Ni-Cr | 1200 | 15.13 | 12.991 |
| 21. 70.0 W + 26.25 Cu + 3.75 Ni-Cr | 1200 | 16.18 | 14.3 |
| 22. 80.0 W + 17.5 Cu + 2.5 Ni-Cr | 1200 | 17.22 | 14.41 |
| 23. 90.0 W + 8.75 Cu + 1.25 Ni-Cr | 1200 | 18.26 | 14.63 |
| 24. 90.0 W + 8.75 Cu + 1.25 Ni-Cr | 1200 | 18.25838 | 14.12 |
| 25. 92.0 W + 7 Cu + 1 Ni-Cr | 1200 | 18.4667 | 14.34 |
| 26. 94.0 W + 5.25 Cu + 0.75 Ni-Cr | 1200 | 18.67503 | 14.53 |
| 27. 96.0 W + 3.5 Cu + 0.5 Ni-Cr | 1200 | 18.88335 | 14.63 |
| 28. 90.0 W + 8.75 Cu + 1.25 Ni-Cr | 1200 | 18.25838 | 14.64 |
| 29. 92.0 W + 7 Cu + 1 Ni-Cr | 1200 | 18.4667 | 14.85 |
| 30. 94.0 W + 5.25 Cu + 0.75 Ni-Cr | 1200 | 18.67503 | 15.04 |
| 31. 96.0 W + 3.5 Cu + 0.5 Ni-Cr | 1200 | 18.88335 | 15.22 |

Figure 15:
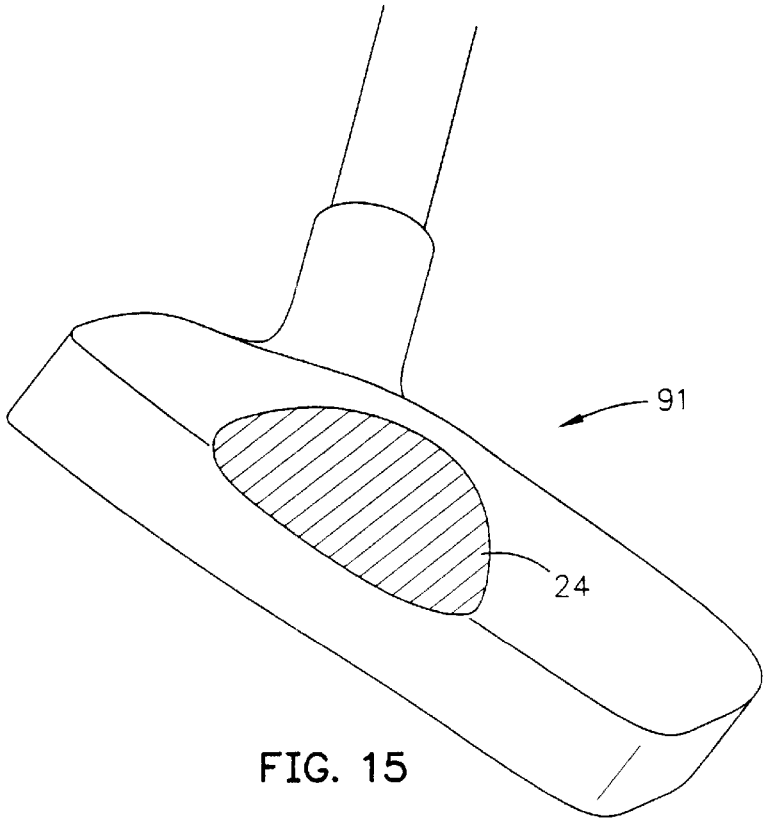
FIG. 15 is a view of a putter golf club head.
Figure 16:
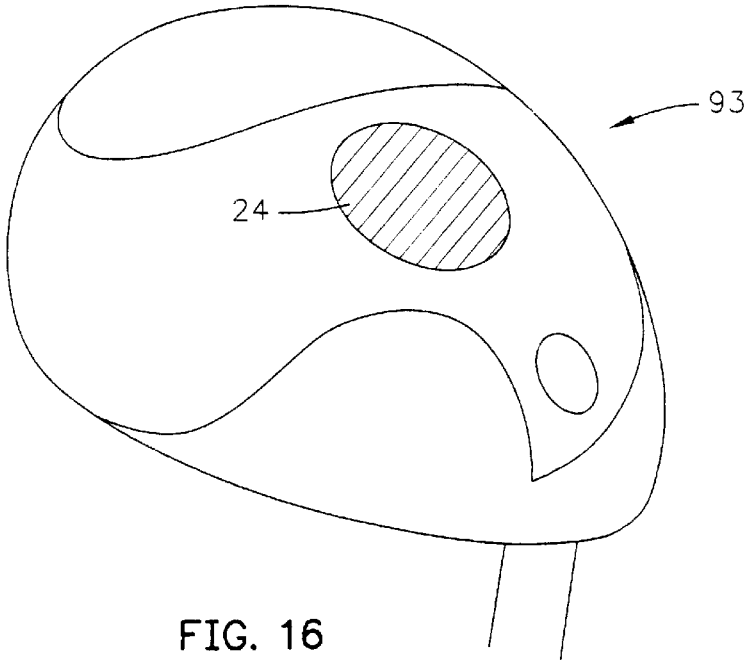
FIG. 16 is a view of a wood golf club head.

Although the present invention has been described in reference to irons, those skilled in the pertinent art will recognize that the present invention may be utilized with putter heads 91 and wood heads 93 as illustrated in FIGS. 15 and 16 respectively.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for manufacturing a golf club head having a weighting member, the method comprising:

providing a golf club head with a cavity;

introducing a multiple component material having a high density component, a binding component and an anti-oxidizing component into the cavity of the golf club head;

wherein the high density component comprises from 5 to 95 weight percent of the weighting member, the binding component comprises from 4 to 49 weight percent of the weighting member and the anti-oxidizing component comprises from 0.5 to 30 weight percent of the weighting member; and heating the golf club head to allow the multiple component material to the liquid phase temperature for liquid phase sintering of at least one component of the multiple component material.

2. The method according to claim 1 further comprising compacting the multiple component material subsequent to introducing the multiple component material.

3. The method according to claim 1 wherein introducing the multiple component material comprises pressuring the plurality of compacts of the multiple component material into the cavity at a pressure between 10,000 pounds per square inch to 100,000 pounds per square inch.

4. The method according to claim 1 wherein heating the multiple component material is performed in an open air environment at one atmosphere of pressure.

5. The method according to claim 1 wherein heating the multiple component material is performed in an inert environment or a reducing environment.

6. The method according to claim 1 wherein the multiple component material is in a powder form prior to heating.

7. The method according to claim 1 wherein the multiple component material comprises tungsten, copper and an anti-oxidizing component.

8. The method according to claim 7 wherein the anti-oxidizing component is selected from the group consisting of chromium, nickel-chrome, stainless steel, nickel superalloy and other chromium alloys.

9. The method according to claim 1 wherein the golf club head is an iron, putter, driver or fairway wood.

* * * * *